US011524217B2

(12) United States Patent
Smith et al.

(10) Patent No.: US 11,524,217 B2
(45) Date of Patent: Dec. 13, 2022

(54) THREE-DIMENSIONAL THROWING GAME TARGET APPARATUS

(71) Applicant: War Pong, LLC, Troy, MI (US)

(72) Inventors: Scott Robert Smith, Saint Clair Shores, MI (US); Gregory Adam Lauckner, Troy, MI (US)

(73) Assignee: WAR PONG, LLC, Troy, MI (US)

( * ) Notice: Subject to any disclaimer, the term of this patent is extended or adjusted under 35 U.S.C. 154(b) by 197 days.

(21) Appl. No.: 16/273,444

(22) Filed: Feb. 12, 2019

(65) Prior Publication Data

US 2019/0247729 A1 Aug. 15, 2019

Related U.S. Application Data

(60) Provisional application No. 62/629,324, filed on Feb. 12, 2018.

(51) Int. Cl.

| | |
|---|---|
| ***A63B 67/06*** | (2006.01) |
| ***A63F 7/00*** | (2006.01) |
| ***A63B 67/00*** | (2006.01) |
| ***A63F 9/00*** | (2006.01) |

(52) U.S. Cl.

CPC ..... *A63B 67/06* (2013.01); *A63B 67/002* (2013.01); *A63F 7/0017* (2013.01); *A63B 2225/09* (2013.01); *A63F 2009/0053* (2013.01)

(58) Field of Classification Search

CPC ..... B65D 85/32; A47F 5/10

See application file for complete search history.

(56) References Cited

U.S. PATENT DOCUMENTS

| | | | | | |
|---|---|---|---|---|---|
| 3,751,098 | A * | 8/1973 | Owen | B65D 71/50 | 294/87.2 |
| D272,699 | S * | 2/1984 | Godfrey | 211/74 | |
| 4,955,485 | A * | 9/1990 | Alton | A47G 1/12 | 211/188 |
| 5,071,026 | A * | 12/1991 | Apps | B65D 1/243 | 206/427 |
| 5,188,413 | A * | 2/1993 | Nathan | B65D 71/50 | 206/199 |
| 5,285,907 | A * | 2/1994 | Franchere | F16M 13/00 | 211/74 |
| 5,335,814 | A * | 8/1994 | Hepp | B65D 71/70 | 220/519 |
| 6,520,366 | B1 * | 2/2003 | Bradley | A47G 19/065 | 220/23.6 |

(Continued)

*Primary Examiner* — Eugene L Kim
*Assistant Examiner* — Christopher Glenn
(74) *Attorney, Agent, or Firm* — Brooks Kushman P.C.

(57) ABSTRACT

A three-dimensional throwing game target apparatus includes platforms, bridge members, connectors and stanchions. The platforms include an outer wall and a platform receptacle ring that is adapted to receive a cup. Each of the bridge members include at least one bridge receptacle ring and a plurality of elongated girders extending outwardly from the bridge receptacle ring. The bridge members and the platforms may be detachably connected to one another in a horizontal plane. The stanchions are assembled to the platforms to support the receptacle rings at a plurality of different heights. The platforms, bridge members, connectors and stanchions may be assembled together to support the platform receptacle rings at selected vertically and horizontally spaced locations.

13 Claims, 9 Drawing Sheets

(56) References Cited

U.S. PATENT DOCUMENTS

| | | | | |
|---|---|---|---|---|
| 9,555,301 | B2 | 1/2017 | Rieman | |
| 9,700,158 | B1 * | 7/2017 | Reed | A47F 5/0018 |
| 2004/0040923 | A1 * | 3/2004 | Wolff | A47G 7/041<br>431/296 |
| 2012/0169012 | A1 * | 7/2012 | Parker | A63B 67/002<br>273/400 |
| 2014/0027983 | A1 * | 1/2014 | Keebler | A63B 67/06<br>273/407 |
| 2014/0263136 | A1 * | 9/2014 | Reinhart | A47B 96/02<br>211/186 |
| 2016/0107827 | A1 * | 4/2016 | Rivera | F25D 25/00<br>211/85.4 |

* cited by examiner

THREE-DIMENSIONAL THROWING GAME TARGET APPARATUS

REFERENCE TO RELATED APPLICATIONS

This application claims the benefit of U.S. provisional application Ser. No. 62/629,324 filed Feb. 12, 2018, the disclosure of which is hereby incorporated in its entirety by reference herein.

TECHNICAL FIELD

This disclosure relates to a three-dimensional throwing game target apparatus.

BACKGROUND

Leisure games date back to ancient times, are integral to all cultures, and encourage social interaction. Common features of games include uncertainty of outcome, agreed upon rules, elements of chance, the thrill of victory, and the agony of defeat. Sporting games are typically played on a field, track, ice rink, or court. Table games, as the name implies, are smaller and only require a table or some other suitable surface. Board games often include a board or panel that may be folded up or disassembled for storage.

Beer pong is one example of a popular table game (often played among college students). Beer pong involves arranging twenty cups, ten on each side of the table, in two triangular formations. Players take turns throwing a ping pong ball into any one of the cups arranged on the opposite side of the table. Placing the cups on the table surface limits the configuration of the cups to a two-dimensional layout. Moreover, the cups may inadvertently slide across or off the table during play.

This disclosure is directed to solving the above problems and other problems as summarized below.

SUMMARY

According to one aspect of this disclosure a three-dimensional throwing game target apparatus is provided. The game target apparatus may include a plurality of platforms, at least one bridge member, and a plurality of stanchions. Each of the platforms may include an outer wall and at least one platform-supported receptacle ring that is adapted to receive a cup. Each of the bridge members may include at least one bridge-supported receptacle ring and a plurality of elongated girders that outwardly extend from the bridge-supported receptacle ring. The bridge member and the platforms may be detachably connected to one another in a horizontal array. The plurality of stanchions may be assembled to the platforms to support the platforms at a plurality of heights. The platforms, bridge members and stanchions may be assembled together to extend in a longitudinal direction, a transverse direction, and a vertical direction.

According to another aspect of this disclosure, a three-dimensional throwing game target apparatus is provided. The game target apparatus may include a plurality of platforms, at least one connection link for connecting two platforms together, and a plurality of stanchions. The plurality of platforms may each include an outer wall and at least one platform-supported receptacle ring that may be adapted to receive a cup. The plurality of stanchions and the at least one connection link may be detachably connected in a horizontal array. The plurality of stanchions may be assembled between the plurality of platforms to support the platforms at a plurality of heights. The platforms, connection link, and stanchions may be assembled together to extend in a longitudinal direction, a transverse direction, and a vertical direction.

According to yet another aspect of this disclosure, a kit for a cup supporting target is provided. The kit may include a plurality of platforms, a plurality of platform connectors, and a plurality of stanchions. The plurality of platforms may each define a first set of cup receptacles and a plurality of recesses. Each of the platforms may have a first set of engagement features. The plurality of platform connectors may include a second set of engagement features that are connectable to the first set of engagement features that hold the platforms in a horizontal plane. The plurality of stanchions may have ends that are each receivable in one of the recesses. The platforms may be adapted to be assembled together in a vertically or horizontally spaced array with the stanchions.

The three-dimensional throwing game target apparatus and the kit for a cup supporting target as generally described above, may include one or more of the following additional aspects.

The game target apparatus may further include a first connection feature that may be provided on each of the platforms and a second connection feature that may be provided on each of the bridge members. The second connection feature may be attached to the first connection feature to secure the bridge member to the platform.

The first and second connection features may be attached to one another by a press-fit condition.

The outer wall of each of the platforms may define a plurality of notches that are adjacent to each of the first connection features. Each of the notches may define a width that corresponds to a width of each of the second connection features.

Each of the platforms may include a plurality of tabs that extend inwardly from an inner periphery of the outer wall and one of the connection features may be provided on one of the tabs.

At least one of the second connection features may be on each one of the elongated girders. At least one of the second connection features may be disposed on a distal end of each of the elongated girders.

A connection link may be provided. The connection link may include two second engagement features that engage one of the first engagement features of a first platform and one of the first engagement features of a second platform to detachably connect the first platform and the second platform.

Each of the plurality of platforms may define a plurality of stanchion receptacles that may be adapted to receive one of the stanchions when assembled to the platform. The stanchion receptacles may be disposed on a top surface and a bottom surface of each of the platforms. The stanchion receptacles and the stanchions may be provided in corners of the plurality of platforms.

Each of the platforms may further include at least one connecting rib that extends between the outer wall and the receptacle ring.

The bridge member may include one or more spaced apart receptacle rings that are connected to one another by at least one intermediate girder.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
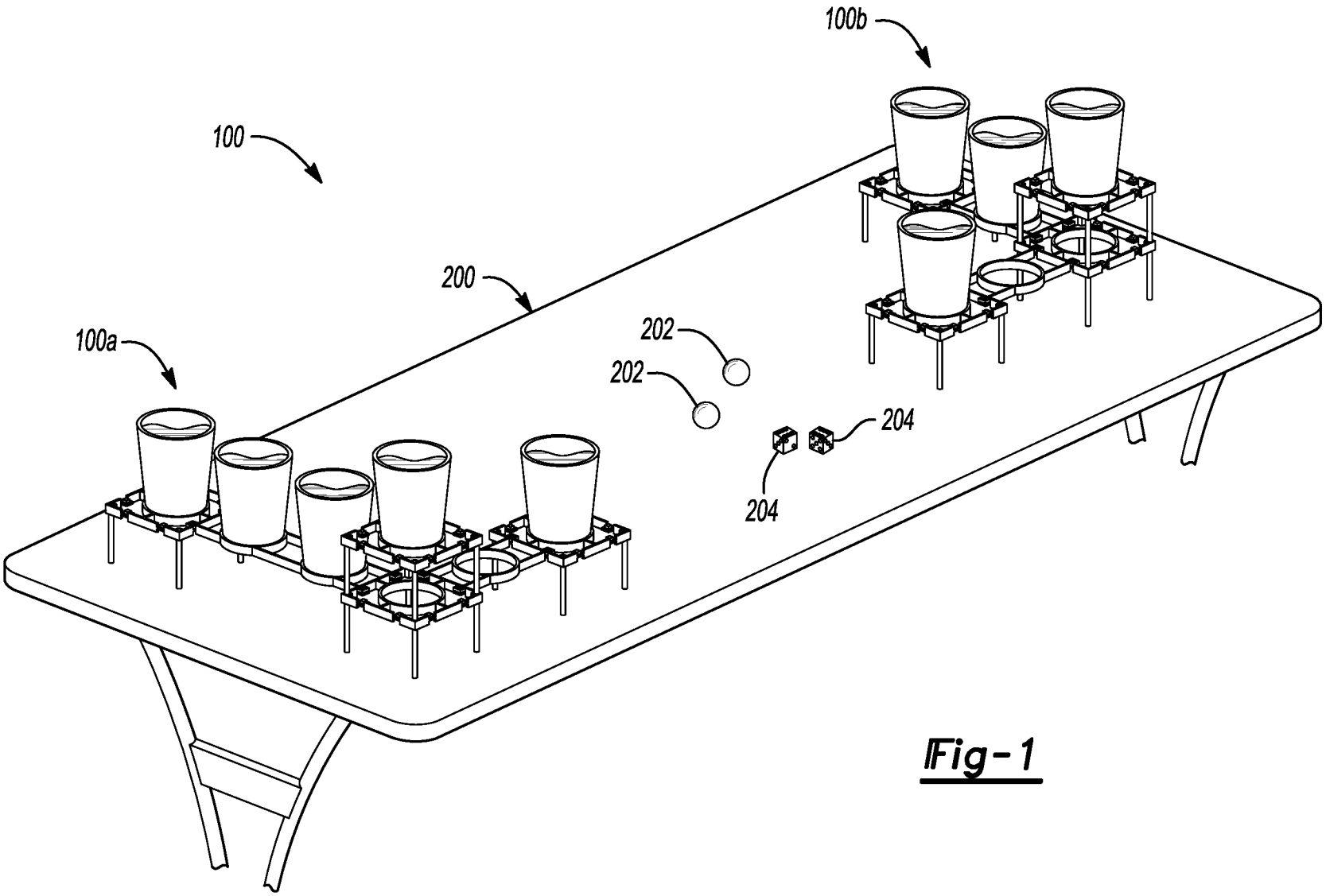
FIG. 1 is an environmental view of a three-dimensional throwing game target apparatus.
Figure 1A:
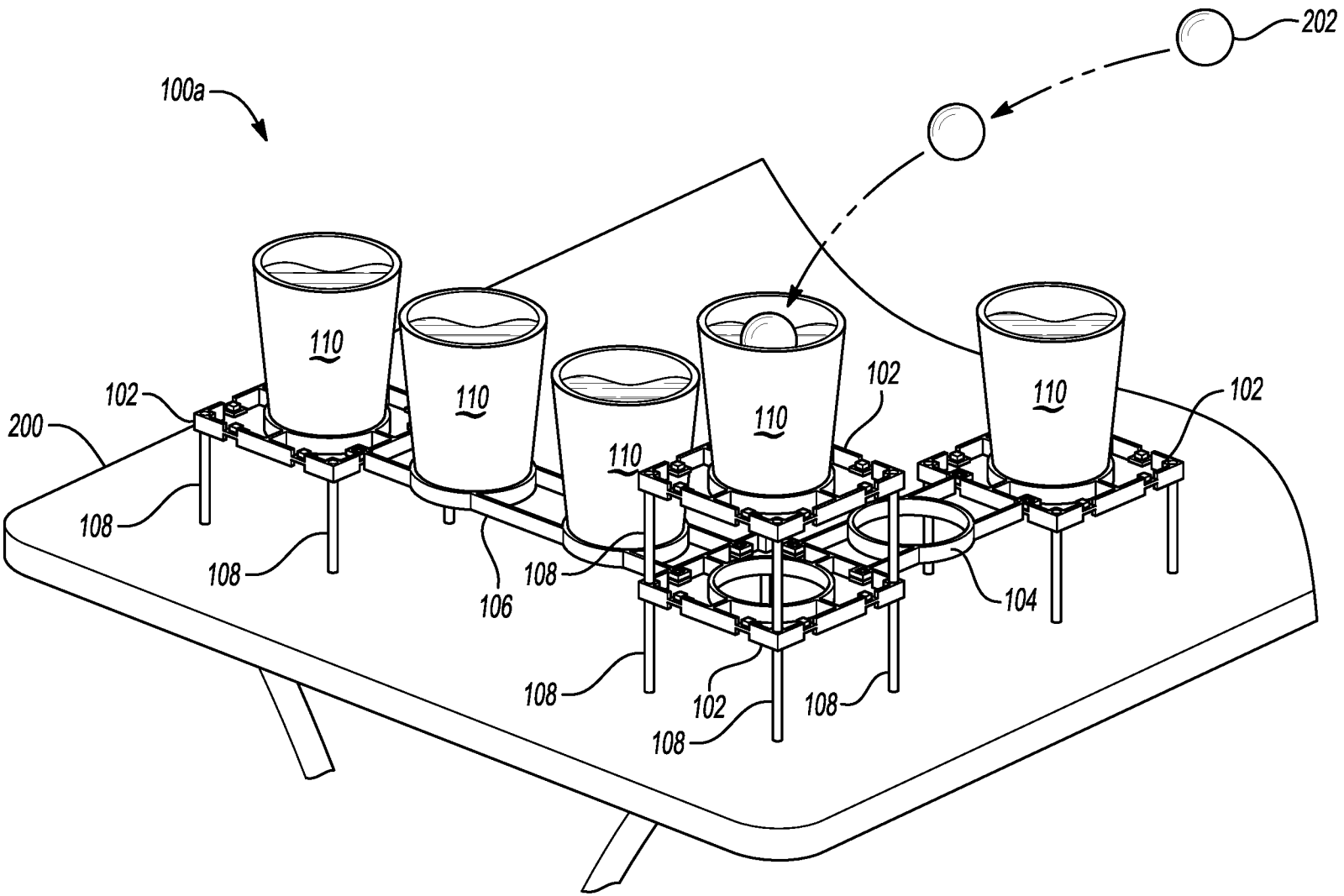
FIGS. 1A-1B are perspective views of first and second assemblies of the three-dimensional throwing game target apparatus.
Figure 1B:
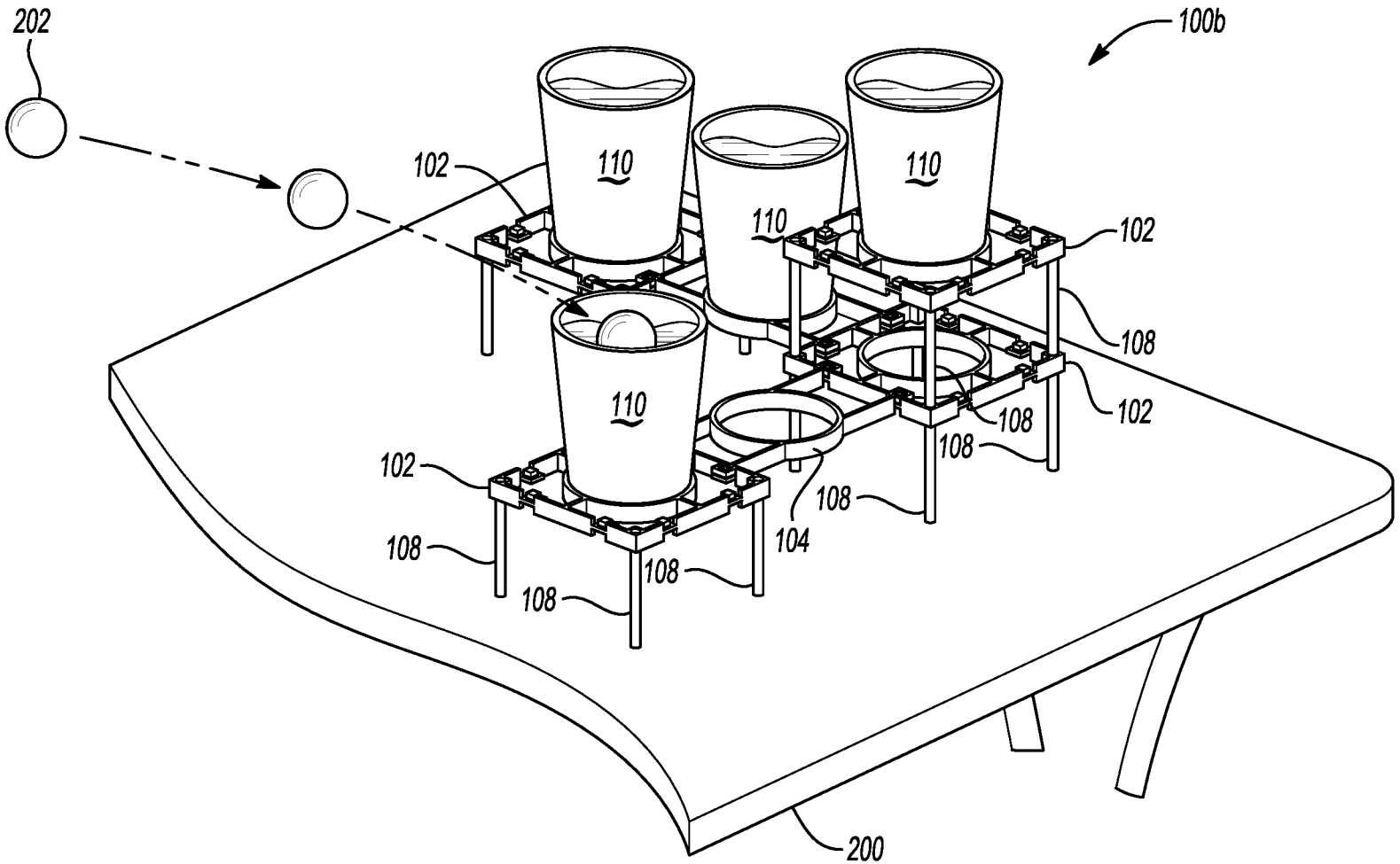

Referring to FIGS. 1, 1A, and 1B, a three-dimensional throwing game target apparatus 100 assembled on a table 200 is illustrated. In the discussion of FIG. 1, a cartesian coordinate system is utilized. A longitudinal direction (y-direction) extends along the length (the longest portion) of the table 200. A horizontal direction (x-direction) extends orthogonal to the longitudinal direction. A vertical direction (z-direction) extends orthogonal to the vertical and horizontal directions (normal to the top surface of the table). As referred to herein, the terms horizontal and vertical should not be interpreted in absolute terms but should be understood to be within 15 degrees relative to strictly horizontal or vertical directions.

The three-dimensional throwing game target apparatus 100 includes a first assembly 100*a*, positioned closest to the near end of the table 200 and a second assembly 100*b*, positioned towards the far end. In some variations, the game may also be played on only one end of a table with all players playing toward the same end. The three-dimensional throwing game target apparatus is played by opposing players or opposing teams of one or more players. Each opponent has one of the assemblies 100*a* or 100*b*. The assemblies include one or more platforms 102 that hold or receive one or more cups 110. The assemblies further include one or more single bridge members 104 or double bridge members 106, or both. The single bridge member 104 holds or receives one cup 110 and the double bridge member 106 holds or receives two cups 110. The platforms 102 and the bridge members 104 and 106 are supported by stanchions 108. The stanchions 108 may be detachably connected to the platforms 102, or the bridge members 104 and 106, or both.

The platforms 102 and the bridge members 104 and 106, may be connected to one another in a horizontal array that extends in the x-direction, or a longitudinal array that extends in the y-direction, or both. Employing the stanchions 108 allows stacking of or elevating of one or more platforms 102, in the z-direction, so that one or more of the platforms 102 is positioned above other platforms 102 or bridge members 104 and 106. As will be described in greater detail below, the platforms 102, bridge members 104 and 106, and stanchions 108 may be detachably connected to one another when assembled. The detachable connection facilitates a relatively easy assembly and disassembly of the assemblies 100*a* 100*b*. The ease of putting together and taking apart the assemblies 100*a* 100*b* enables building various configurations quickly.

The three-dimensional throwing game target apparatus 100 may include one more balls 202 that are shown between the first assembly 100*a* and the second assembly 100*b*. The opposing teams or players may alternate turns throwing the balls 202 into the cups 110. As one example, the opponents alternate turns attempting to land one or more of the balls 202 into one of their opponent's cups 110. The opponents may throw at least one of the balls 202 towards a specified cup 110 or towards the remaining cups 110 in general, with the goal of landing one of the balls 202 into any of their opponent's cups 110. When one of the opponents lands at least one of the balls 202 into the other opponent's cups 110, that opponent removes the cup. The first opponent forced to remove all their cups 110 loses and the team with remaining cups wins. The game target apparatus 100 may also include dice 204 that are rolled to specify a certain action based on the rules of the game. The color of the cups may correspond to the color on each side rolled on a die or dice 204. In another embodiment, the dice or die 204 may indicate how many cups 110 may be removed if the subsequent shot lands into one of the cups 110. In another embodiment, the dice may have six sides, each side having a symbol (e.g., 1× (as in 1 times), 2×, 3×, and "WAR PONG"). The other die may include the words, "Add Cup," "Remove Cup," "Extra Shot," "Lose Shot," "Multiplier," and "WAR PONG." The stanchions 106 may be cylindrical dowels, as illustrated. The stanchions 108 have an elongated cylindrical shape with a circular outer surface. But the stanchions 108 may have another shape, e.g., rectangular, square, polygonal, etc. The stanchions 108 may vary in length so that the platforms 102 and bridge members 104 and 106, are positioned at various heights.

Figure 2:
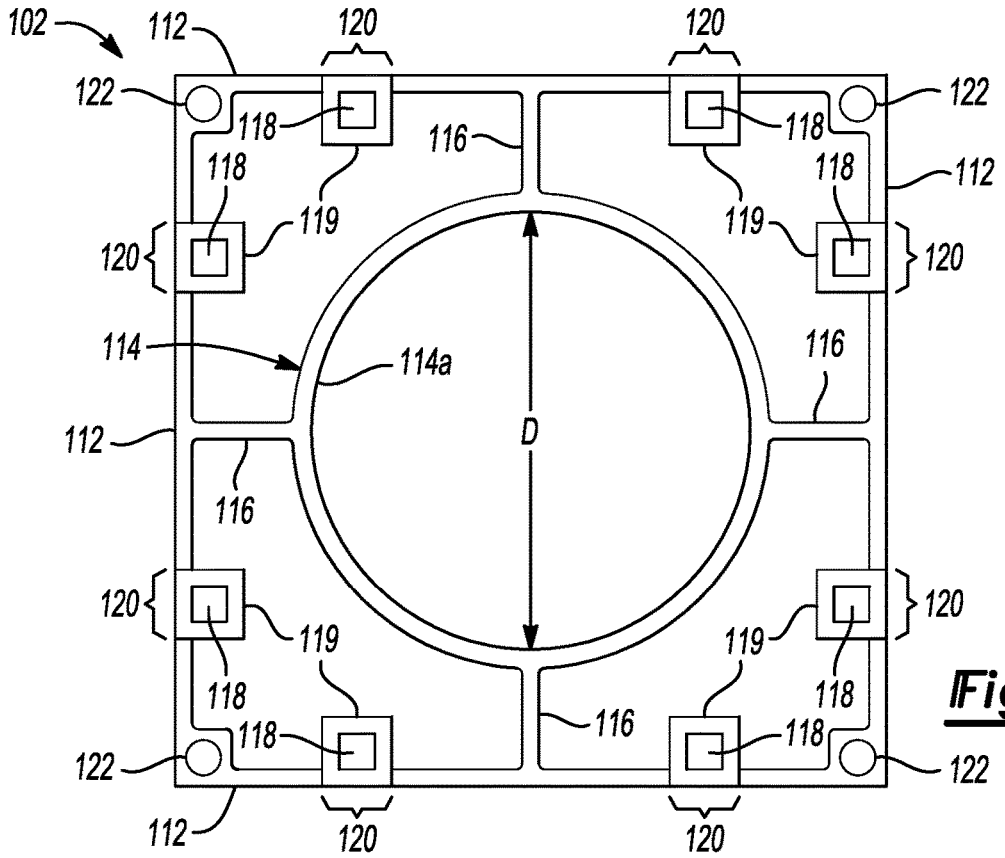
FIG. 2 is a top view of a platform of the three-dimensional throwing game target apparatus.

Referring to FIG. 2, a top view of platform 102 that includes an outer wall 112 and a container ring is provided. The container ring may be referred to as a receptacle ring or a platform-supported receptacle ring 114. The platform-supported receptacle ring 114 defines an inner periphery 114*a* that defines an inner diameter D. The inner diameter D is sized to support or hold the cup 110. The outer wall 112 includes first engagement or connection features, such as protrusions 118. The protrusions 118 are sized and shaped to engage second engagement (or connection) features, such as apertures 124 illustrated in FIGS. 3-6. The protrusions 118 and apertures 124 may be attached to one another by a press-fit condition.

In another embodiment, the first and second connection features 118 and 124 may be attached to one another by press-fit condition, or other suitable fastening method. Alternatively, the first connection features and the second connection features may be in the form a dovetail joint. A dovetail joint typically includes one or more tapered protrusions that engage one or more tapered notches. In another example, the first connection feature may be a clip or similar device that engages the second set of connection features. As another example, the first connection features may be a pocket, slot, or channel that defines an inner periphery that engages second connection features, such as a protrusion or tab. The terms first and second are interchangeable and are not meant to be limiting.

The outer wall 112 of the platform 102 may further define a set of notches 120 that are aligned with the protrusions 118. A set of tabs 119 may be aligned with each of the notches 120 to extend inwardly from the outer wall 112. The protrusions 118 may extend from each of the tabs 119. The outer wall 112 may further define a set of stanchion apertures 122 (or receptacles) that receive one of the stanchions 108. The stanchions 108 may engage an inner periphery of the stanchion apertures 122 so that they are detachably connected to one another. The size of the stanchion apertures 122 and the size of the stanchions correspond to one another to form a press-fit condition when assembled. The stanchion apertures 122 may be disposed within the corners of the outer wall 112 as well as on a top surface (illustrated) and bottom surface (not illustrated) of the platform 102.

Figure 3:
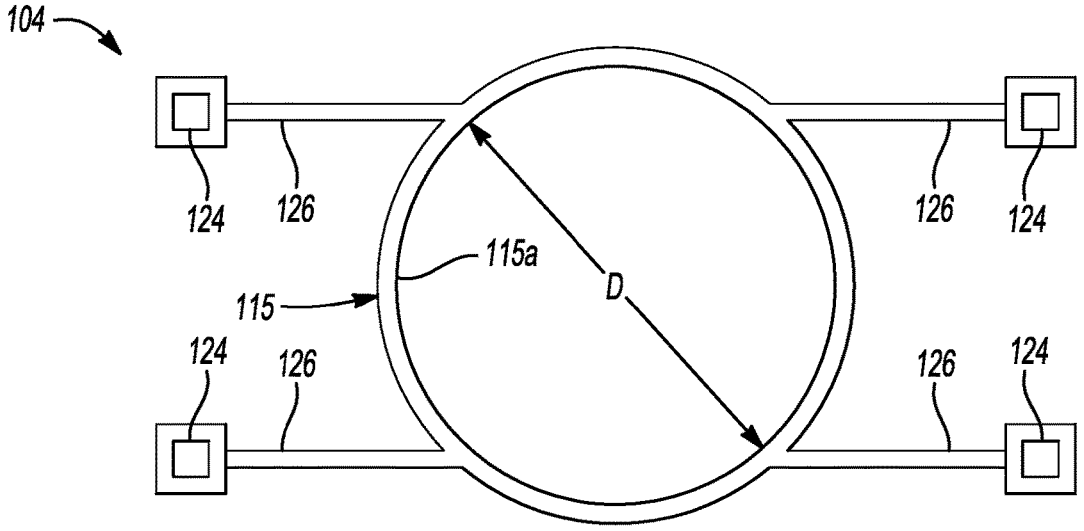
FIG. 3 is a top view of a single bridge member of the three-dimensional throwing game target apparatus.

Referring to FIG. 3, a top view of a single bridge member 104 is illustrated. The single bridge member 104 includes one bridge-supported receptacle ring 115. The double bridge member 106 (FIG. 5) includes two bridge-supported receptacle rings 115. The bridge members 104 and 106 include connecting members, such as elongated girders 126, that extend outwardly from the bridge-supported receptacle rings 115.

Figure 4:
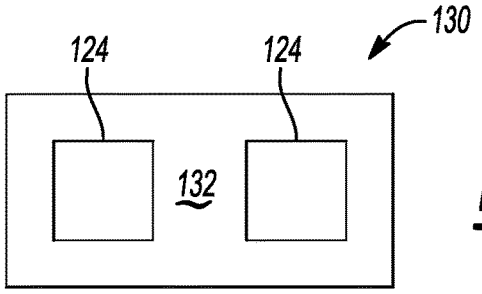
FIG. 4 is a top view of a connecting member of the three-dimensional throwing game target apparatus.

Referring to FIG. 4, a top view is illustrated of a connecting member or connecting link 130. The connecting link 130 may detachably connect one or more platforms 102 to one another. Alternatively, the connecting link 130 may connect the single bridge member 104 or the double bridge member 106 to one another or to a platform 102. The connecting link 130 includes two engagement features, such as the connecting apertures 124 as previously described above. The connecting link 130 includes an intermediate portion 132 disposed between the two connecting apertures 124. The distance between the connecting apertures 124 may vary. At a minimum, the width of the intermediate portion 132 between the connecting apertures must be large enough to be attached to protrusions of a pair of assembled platforms 102. As the width of the intermediate portion 132 increases, the space between the first and second platforms 102 also increases.

Figure 5:
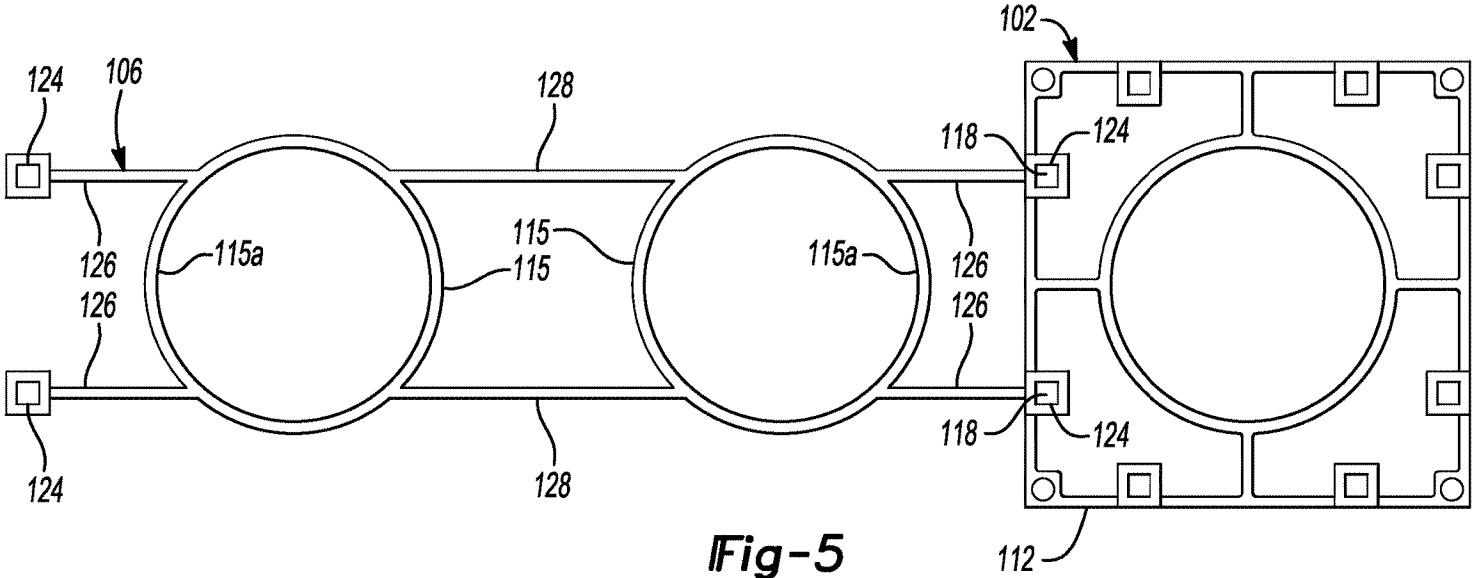
FIG. 5 is a top view of a double bridge member connected to a platform of the three-dimensional throwing game target apparatus.
Figure 6:
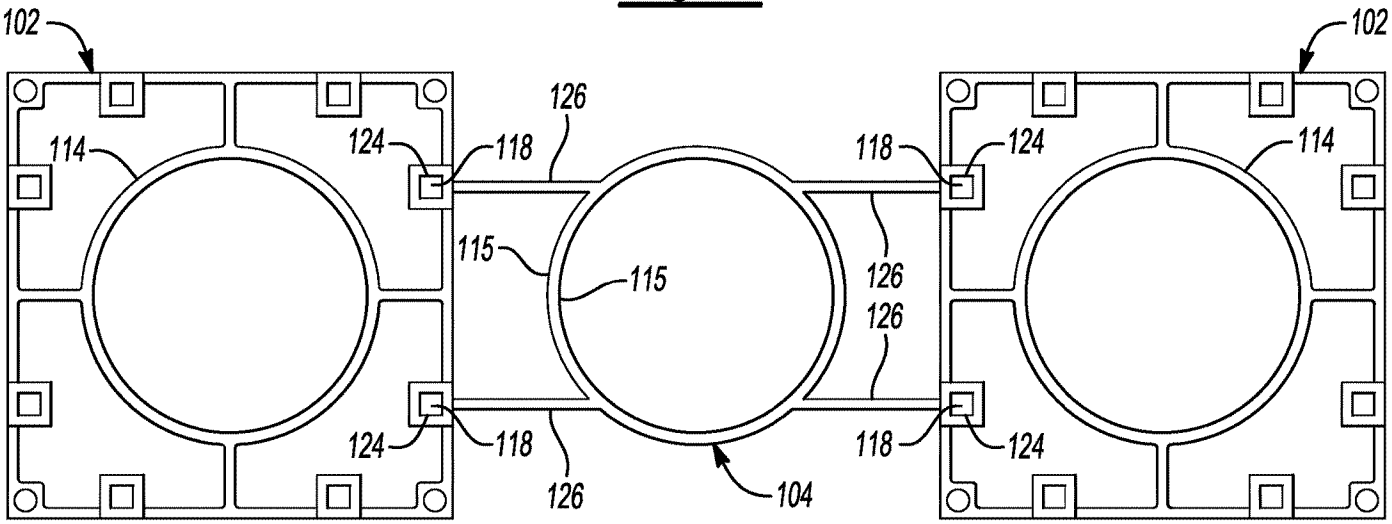
FIG. 6 is a top view of a single bridge member connected to a platform of the three-dimensional throwing game target apparatus.

FIGS. 5 and 6 are top views illustrating a single bridge member 104 and a double bridge member 106 that are each connected to platforms 102, respectively. While only the single bridge member 104 and the double bridge member 106 are shown, other embodiments may include bridge members that have three or more bridge-supported receptacle rings 115.

The elongated girders 126 may be integrally formed with the bridge-supported receptacle rings 115. Alternatively, the girders may be detachably connected to the bridge-supported receptacle rings 115 with a press-fit connection, fasteners, or other suitable methods. The elongated girders 126 define a first set of connection features, such as connecting apertures 124, that engage the second set of connection features, such as the protrusions 118, defined by the platform 104 (FIG. 2). The elongated girders 126 and associated apertures 124 are spaced apart from one another by a distance that is equal to the distance between the protrusions 118 of the platform 102. In another embodiment, the connecting apertures 124 may be defined by the platform 102 as opposed to the girders 126. Alternatively, the platform 102 and the elongated girders 126 may each include one or more protrusions 118 and one more apertures 124 disposed in an alternating pattern.

In an alternative embodiment, the bridge members 104 and 106 may be supported by one or more stanchions 108 as previously described with reference to the platform 102.

Figure 7:
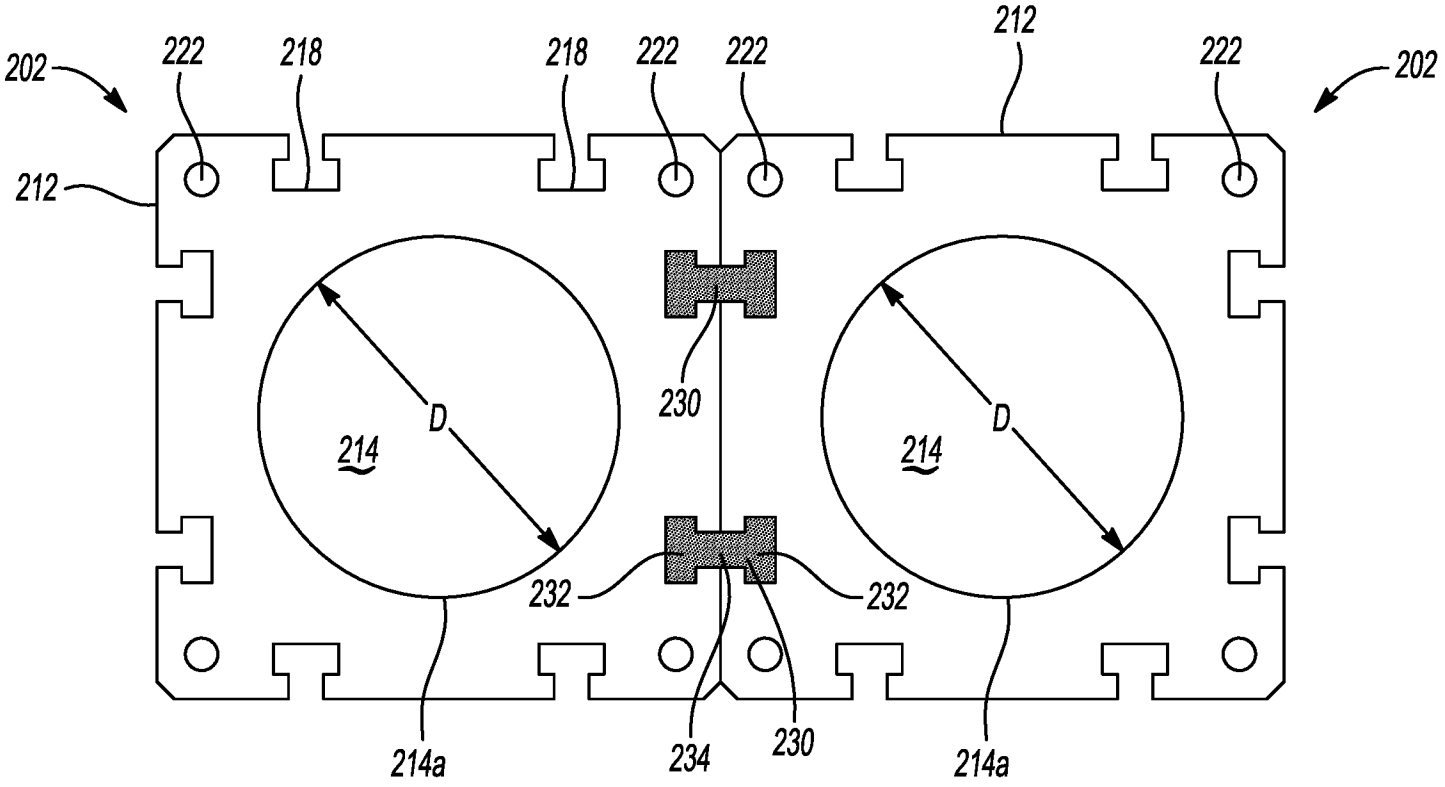
FIG. 7 is a top view of a pair of connected platforms according to a second embodiment.

Referring to FIG. 7, a top view is provided of a pair of connected platforms 202 according to a second embodiment. The pair of platforms 202 are connected by two connecting members 230. Each of the platforms 202 define a receptacle aperture 214 that includes an inner periphery 214*a*. The receptacle aperture 214 defines an inner diameter D that is adapted to receive the one of the cups 110. The platforms 202 include an outer wall 212 that defines first engagement features, such as T-shaped notches 218. The connecting members 230 may have a dog-bone shape and include two connecting ends 232 connected by an intermediate portion 234. The width of the intermediate portion 234 is less than the width of the connecting ends 232. The connecting ends 232 may engage the T-shaped notches in a press-fit connection or any other suitable connection. Each of the platforms 202 define a set of stanchion receptacles or apertures 222 that receive one of the stanchions 108.

The platforms 102, the bridge members 104 and 106, and stanchions 118 may be comprised of a plastic or polymeric material that is produced by injection molding, additive manufacturing (e.g., three-dimensional printing), or other suitable methods.

Figure 8:
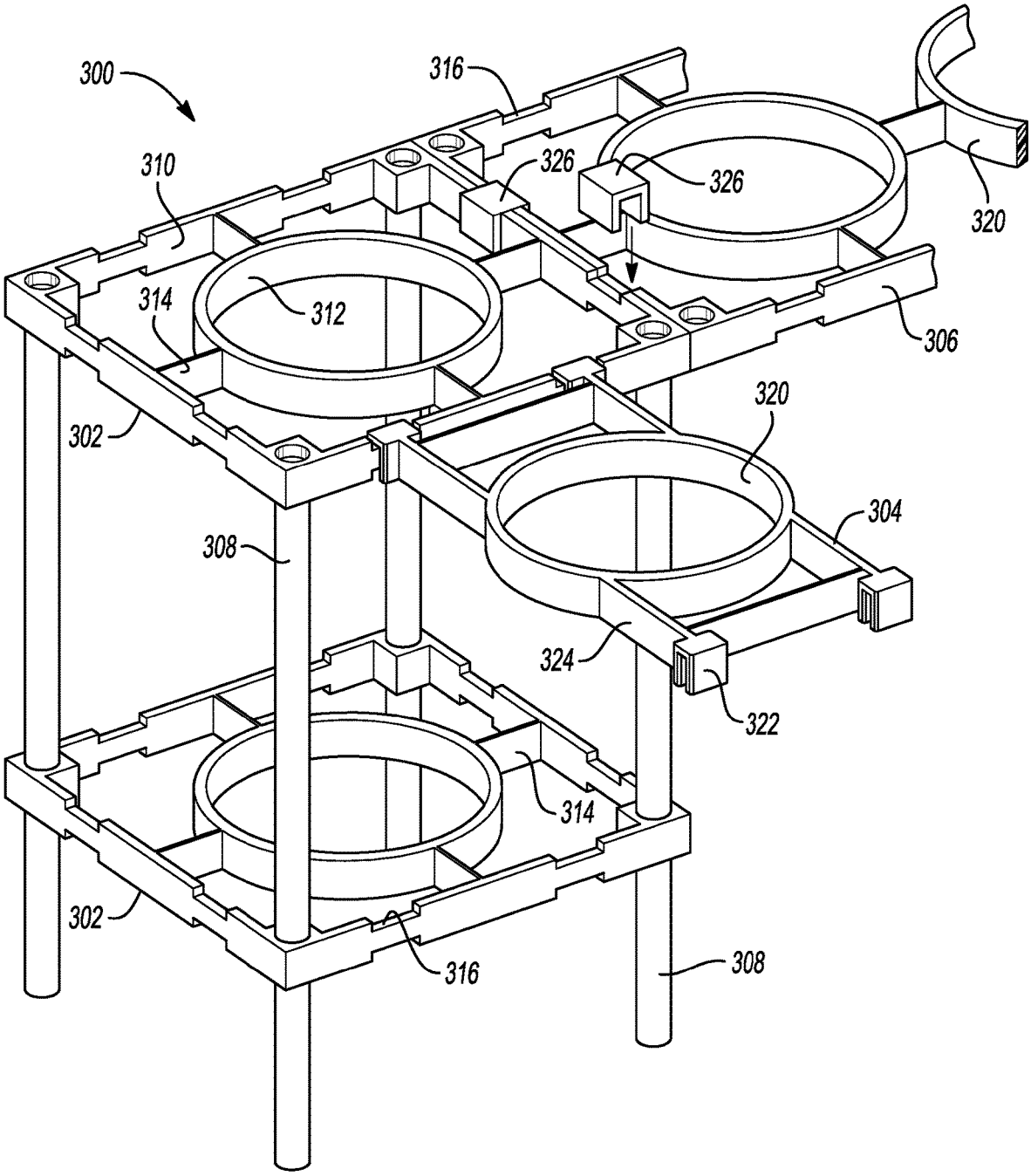
FIG. 8 is a fragmentary perspective view of one example of a target apparatus of the embodiment of FIG. 8 partially assembled together.
Figure 10:
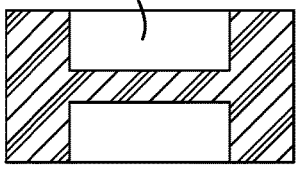
FIG. 10 is a cross-section view taken along the line 10-10 in FIG. 9.
Figure 9:
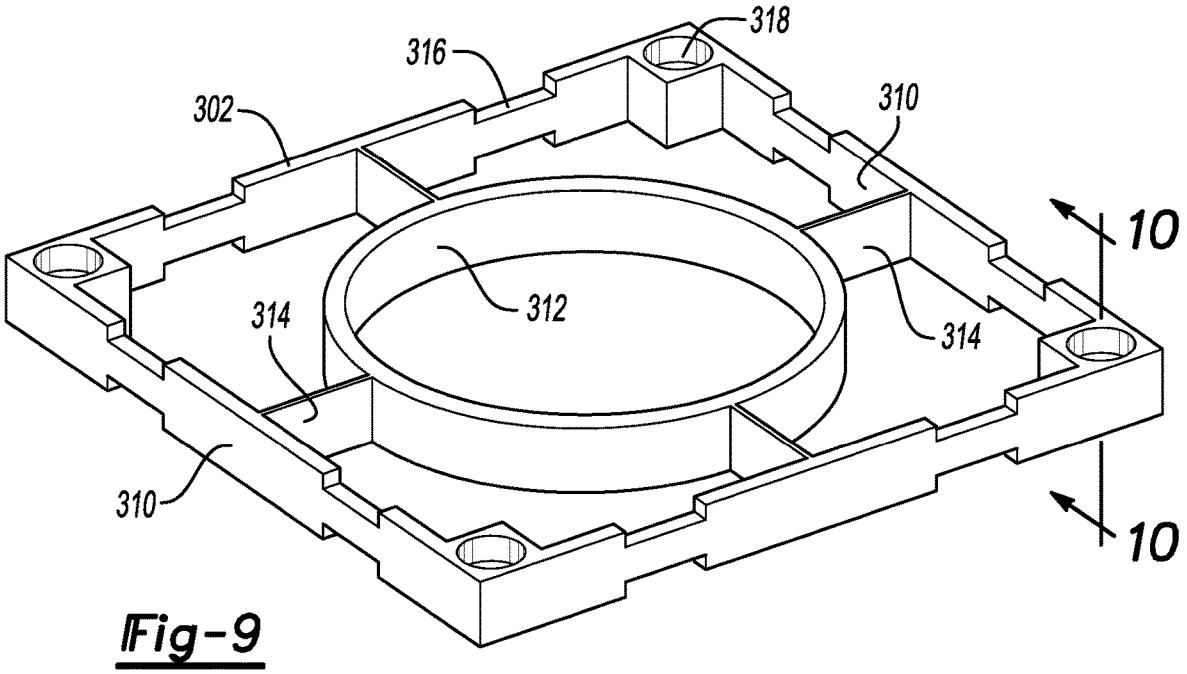
FIG. 9 is a perspective view of an alternative embodiment of a platform of the three-dimensional throwing game target apparatus.
Figure 11:
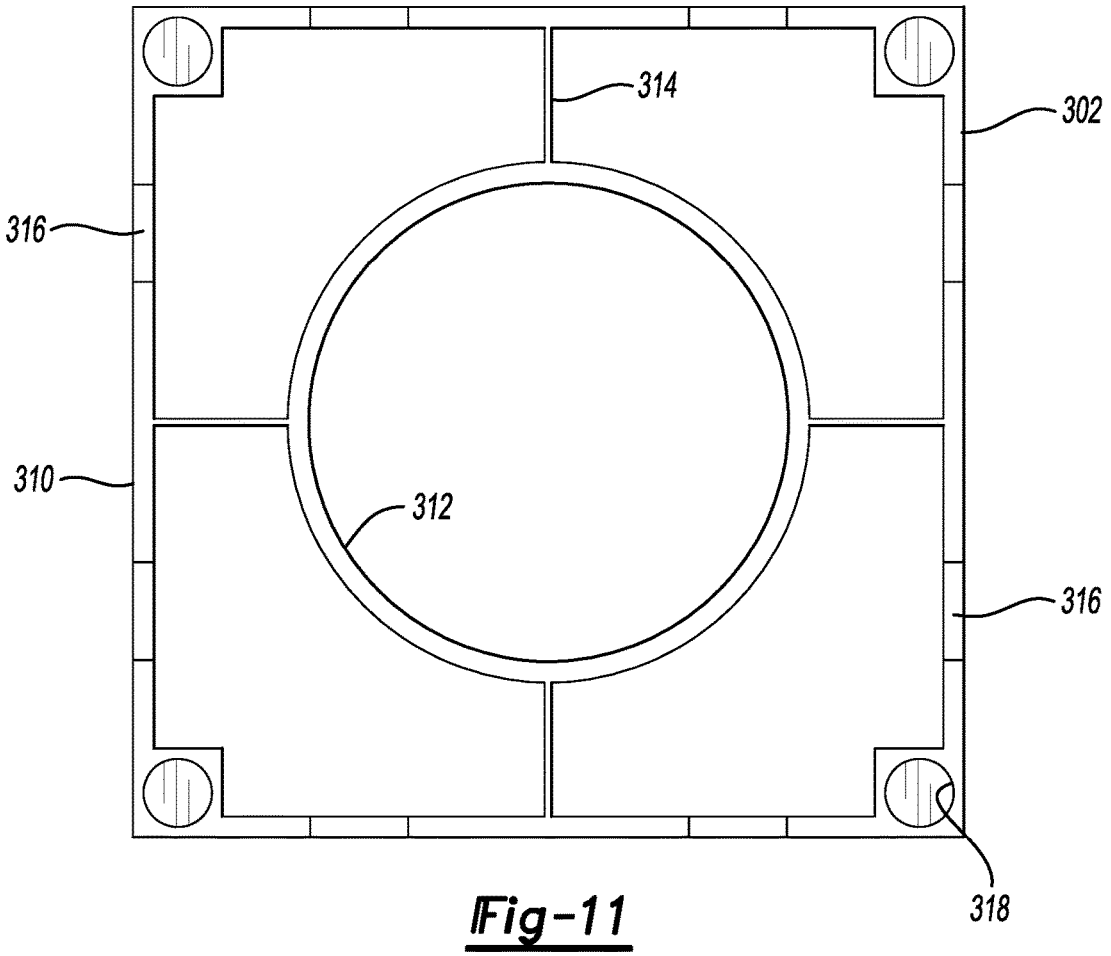
FIG. 11 is a plan view of a platform of the embodiment of FIG. 8 of the three-dimensional throwing game target apparatus.

Referring to FIG. 8, an alternative embodiment of a target apparatus 300 is partially illustrated with two platforms 302, a bridge member 304, a double bridge member 306, and a plurality of stanchions 308 are shown connected to each other. The platforms 302 and bridge members 304 and 306 on a top level of the target apparatus 300 are disposed in a horizontal plane. The two platforms 302 are held by the stanchions 308 in a vertically spaced relationship with one platform 302 being disposed above the other platform 302. The two platforms may also be spaced vertically and spaced apart horizontally in a wide range of possible arrangements.

Referring to FIGS. 8-11, the platforms 302 are described in greater detail. The platforms 302 include an outer wall 310 and a receptacle ring 312 that is supported within the outer walls 310 by ring support ribs 314. Notches 316 are defined in the outer walls 310 U-shaped connectors 322 of the bridge members 304 and 306, as will be described below with reference to FIGS. 8, 12 and 13. The notches 316 allow U-shaped connectors 322 to be seated flush on the upper edge of the outer walls 310. Stanchions 308 are received in the stanchion receptacles 318 located in the corners of the platforms 302. In the embodiment of FIG. 8 the stanchions are hollow tubular members similar to a plastic drinking straw.

Figure 12:
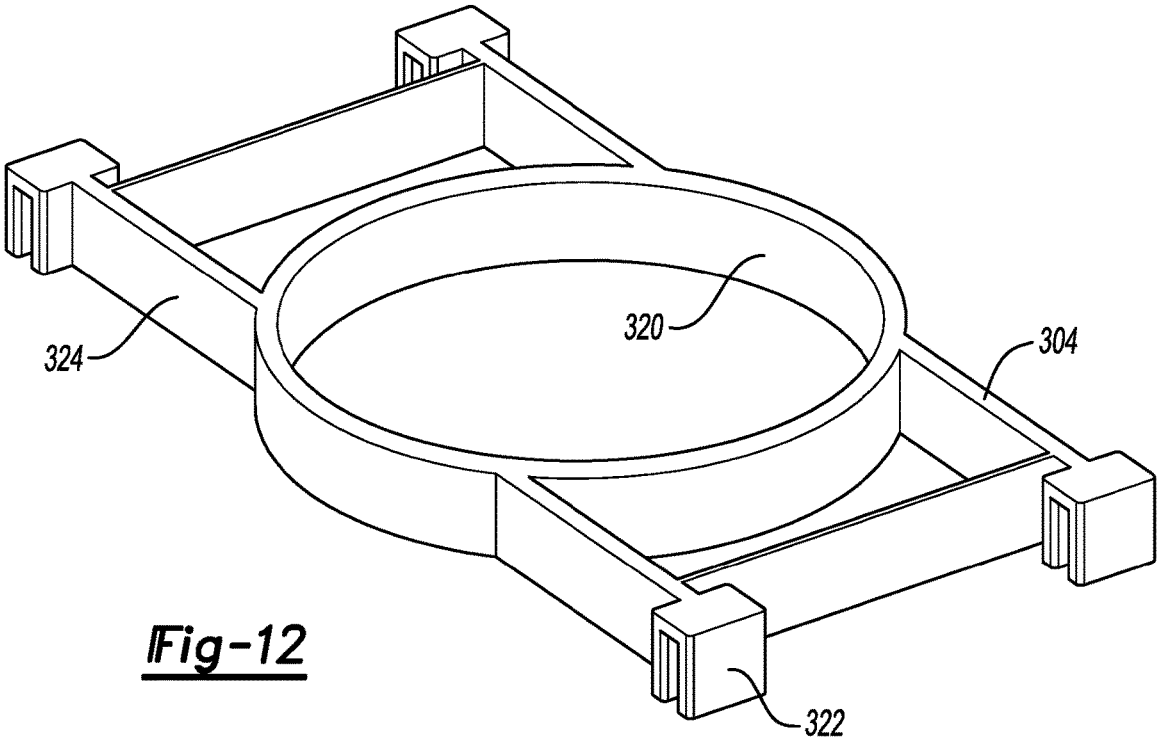
FIG. 12 is a perspective view of a single bridge member of the embodiment of FIG. 8 of the three-dimensional throwing game target apparatus.
Figure 13:
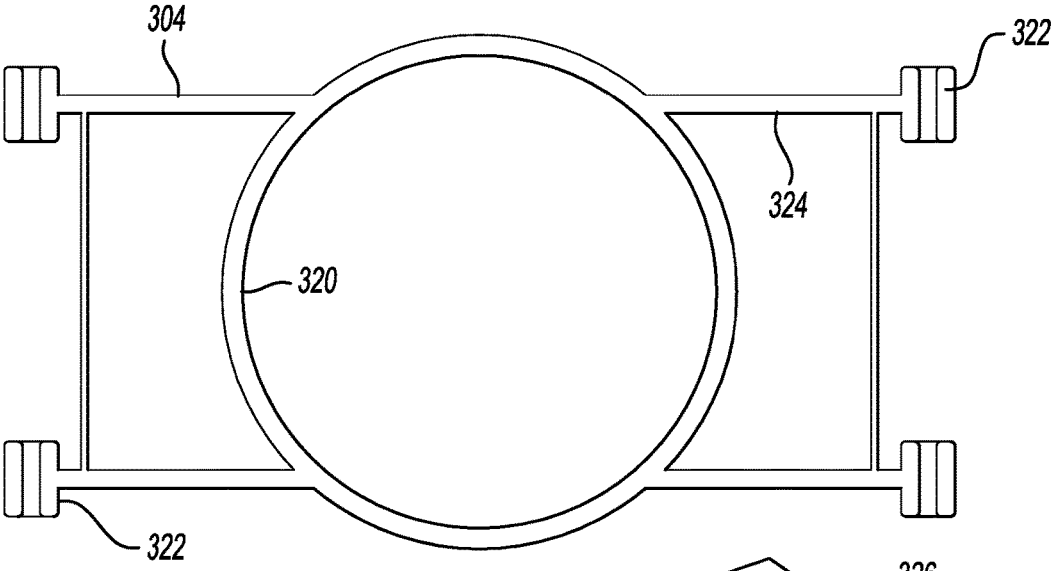
FIG. 13 is a plan view of a platform of the embodiment of FIG. 8 of the three-dimensional throwing game target apparatus.

Referring to FIGS. 8, 12 and 13, the bridge member 304 is shown to include a bridge-supported receptacle ring 320 that is adapted to receive a cup 110 as shown in FIGS. 1A and 1B. The bridge member 304 includes U-shaped connectors 322 on the distal end of a girder 324. The U-shaped connectors 322 are adapted to be received in the notches 316 formed in the top edge of the outer walls 310 of the platforms 302. The U-shaped connectors may be assembled to the top edge of the outer walls 310 without the notches or beside the notches 316.

Figure 14:
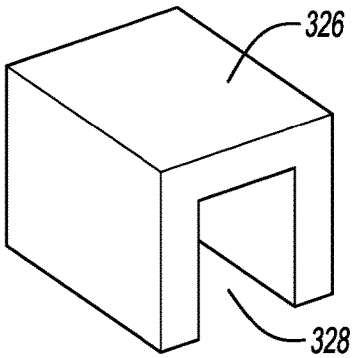
FIG. 14 is a perspective view of one example of a connecting link of the embodiment of FIG. 8 of the three-dimensional throwing game target apparatus.

Referring to FIGS. 8 and 14, a connecting link 326 is shown that may be used to assemble two platforms 302 together in a side-by-side arrangement in a horizontal plane. The connecting link is generally U-shaped like the U-shaped connectors on the bridge members 304 but the slot 328 is wider to be able to receive the outer walls of two adjacent platforms 302.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A three-dimensional throwing game target apparatus comprising:

a plurality of platforms each including an outer wall and at least one platform receptacle ring that is adapted to receive a cup;

at least one bridge member including at least one bridge-supported receptacle ring and a plurality of elongated girders extending outwardly from the bridge-supported receptacle ring in a horizontal plane, wherein the bridge members are attached to the outer wall of two laterally adjacent platforms; and a plurality of stanchions assembled between two of the plurality of vertically adjacent platforms that are vertically spaced apart, wherein the platforms are supported at a plurality of different heights, and wherein the platforms, bridge members and stanchions are assembled together to support platform receptacle rings at selected vertically and horizontally spaced locations, wherein the bridge members are not directly connected to the stanchions.

2. The three-dimensional throwing game target apparatus of claim 1 further comprising:

first connection features provided on each of the platforms; and second connection features provided on each of the bridge members that are attached to the first connection features to secure each of the bridge members to one of the platforms.

3. The three-dimensional throwing game target apparatus of claim 2 wherein the first connection features and the second connection features are attached to one another.

4. The three-dimensional throwing game target apparatus of claim 3 wherein the outer wall of each of the platforms defines a plurality of notches that are adjacent to each of the first connection features.

5. The three-dimensional throwing game target apparatus of claim 4 wherein each of the platforms include a plurality of ribs that extend inwardly from an inner periphery of the outer wall and wherein each of the first connection features is provided on one of the walls.

6. The three-dimensional throwing game target apparatus of claim 2 wherein one of the second connection features is provided on each of the elongated girders.

7. The three-dimensional throwing game target apparatus of claim 6 wherein the elongated girders have a distal end on which one of the second connection feature is provided, wherein the second connection feature defines a slot that is adapted to receive the outer wall of one of the platforms.

8. The three-dimensional throwing game target apparatus of claim 2 further comprising a connection link that includes one or more second connection features that engage one of the first connection features of a first platform and one of the first connection features of a second platform to detachably connect a first one of the platforms and a second one of the platforms to be disposed adjacent to each other.

9. The three-dimensional throwing game target apparatus of claim 1 wherein each of the plurality of platforms defines a plurality of stanchion receptacles, wherein the platforms define stanchion receptacles in a top surface and a bottom surface of the platforms, wherein the stanchion receptacles are each adapted to receive one of the stanchions, and wherein each of the stanchions are detachably assembled to one of the receptacles in the top surface of one of the platforms and one of the receptacles in the bottom surface of a second one of the platforms.

10. The three-dimensional throwing game target apparatus of claim 9 wherein the stanchion receptacles are provided on a top surface and a bottom surface of each of the platforms.

11. The three-dimensional throwing game target apparatus of claim 9 wherein the stanchion receptacles are each provided in a corner of the platforms.

12. The three-dimensional throwing game target apparatus of claim 1 wherein each of the platforms further includes at least one connecting rib that extends between the outer wall and the receptacle ring.

13. The three-dimensional throwing game target apparatus of claim 1 wherein the bridge member includes two spaced apart receptacle rings that are connected to one another by at least one intermediate girder.

* * * * *